United States Patent [19]

Edwards

[11] Patent Number: 4,741,729

[45] Date of Patent: May 3, 1988

[54] MULTI-PACKAGING DEVICES, METHODS AND MACHINES

[75] Inventor: Bryant Edwards, Clarendon Hills, Ill.

[73] Assignee: Illinois Tool Works Inc., Chicago, Ill.

[21] Appl. No.: 890,732

[22] Filed: Jul. 28, 1986

Related U.S. Application Data

[62] Division of Ser. No. 768,587, Aug. 23, 1985, Pat. No. 4,624,363.

[51] Int. Cl.[4] ..... B65B 27/04; B31B 1/14; B31B 1/88

[52] U.S. Cl. ..... 493/339; 493/352; 493/363; 294/87.2

[58] Field of Search ..... 206/150, 151, 156, 161; 294/87.2; 493/72, 352, 402, 363, 446, 447, 430, 339; 53/48, 441, 556

[56] References Cited

U.S. PATENT DOCUMENTS

| | | | |
|---|---|---|---|
| 2,364,342 | 12/1944 | Bruker | 493/402 X |
| 3,074,324 | 1/1963 | Nobbe | 493/402 |
| 4,219,117 | 8/1980 | Weaver et al. | 206/150 |
| 4,356,914 | 11/1982 | Olsen et al. | 206/150 |
| 4,462,494 | 7/1984 | Cunningham | 206/161 X |

*Primary Examiner*—Horace M. Culver

*Attorney, Agent, or Firm*—Thomas W. Buckman

[57] ABSTRACT

Plastic carrier devices that are corrugated to create alternating thick rib sections, that have not been stretched and thin fully oriented sections. Applicating techniques that utilize the ability to pretension the devices to be fed onto an applicating drum are part of the multi-packaging system of this invention.

3 Claims, 4 Drawing Sheets

Fig. 1
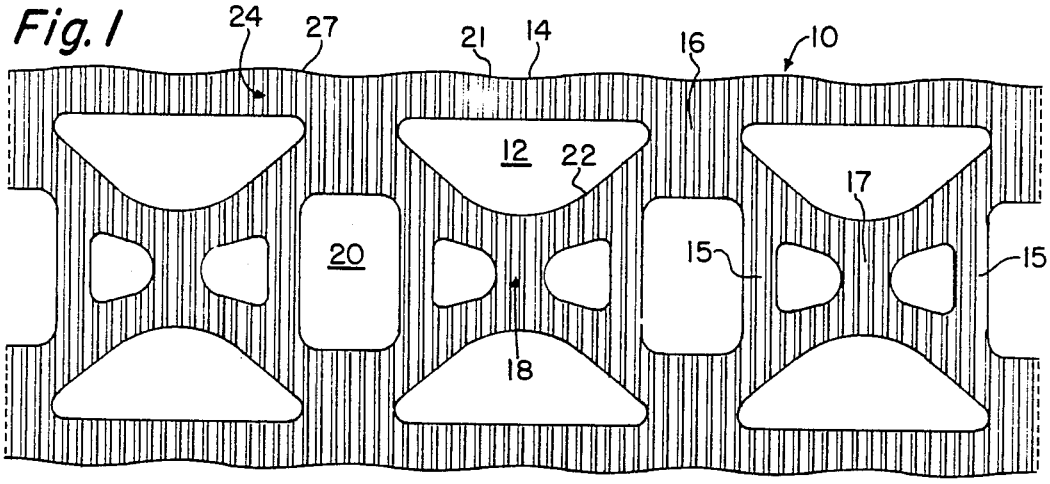
Fig. 2
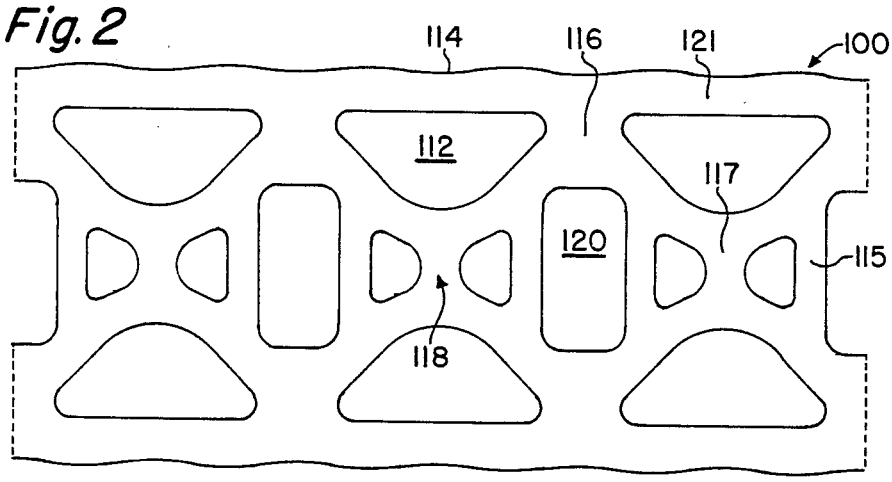
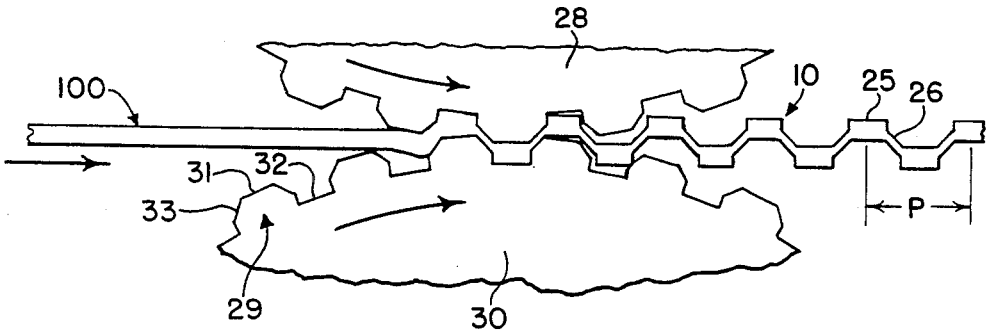
Fig. 3

Fig. 7
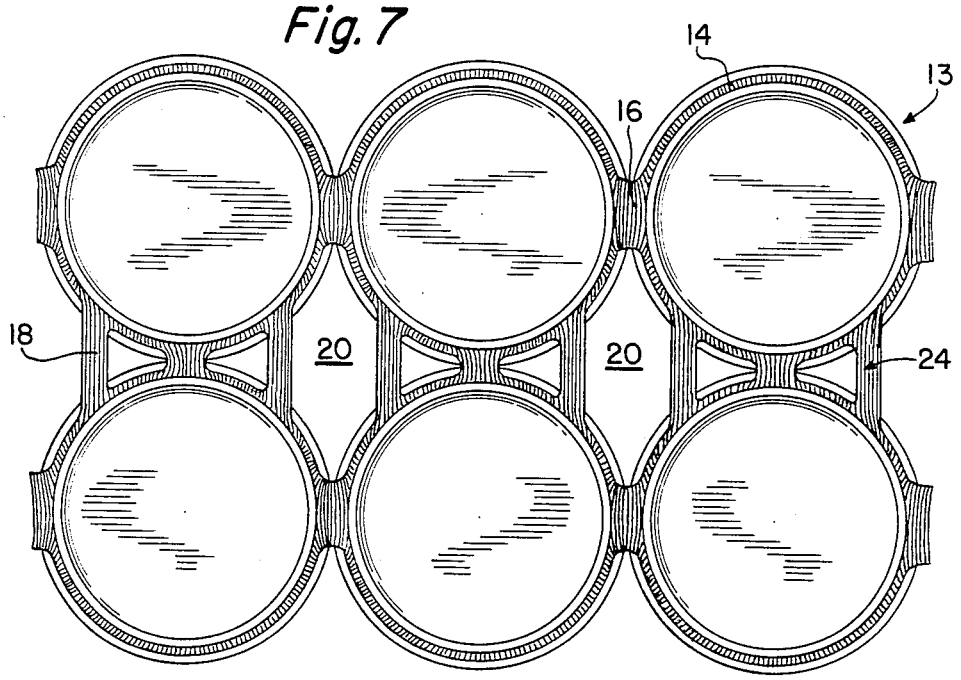
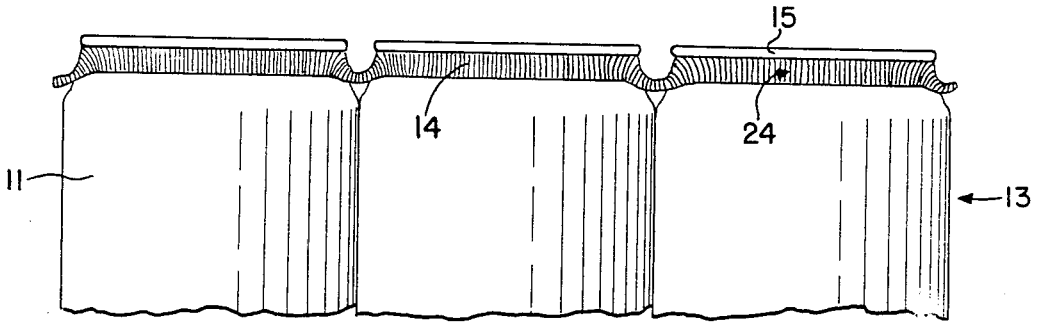
Fig. 8
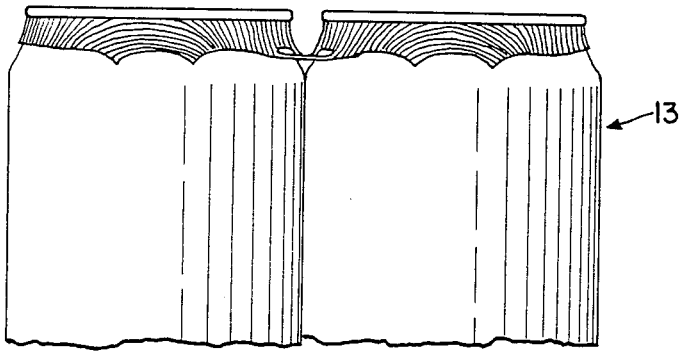
Fig. 9

MULTI-PACKAGING DEVICES, METHODS AND MACHINES

This is a division of application Ser. No. 768,587 filed Aug. 23, 1985 and now U.S. Pat. No. 4,624,363.

BACKGROUND OF THE INVENTION

This invention relates to plastic devices for forming packages for a plurality of containers. More specifically, the invention relates to a multi-packaging device, strip-stock for producing such a multi-packaging device, methods of producing the device and methods and machinery for applying device to containers.

Multi-packaging devices configured from plastic material strips of integrally connected, resilient bands have become commonplace in the prior art of formation of packages for an array of containers. Various machines and methods have also been developed for application of the strips in a high speed production line basis.

Packaging devices of the type referred to above began with the early developments described in U.S. Pat. No. 2,874,835 and have been continually improved up to and including the devices shown in U.S. Pat. No. 4,119,117. Likewise, machinery and method for applying the carriers have been described in various U.S. patents starting with U.S. Pat. Nos. 3,032,943, 3,032,944, and 3,383,828 up to and including U.S. Pat. No. 4,250,682. Present commercial versions of such multi-packaging systems which include the devices, machinery and methods, incorporate the latest of each of the above noted patents.

SUMMARY OF THE INVENTION

Against the foregoing background, the present invention represents a clearly unique advance in carrier design, applicating and production methods.

Briefly stated, the multi-packaging device of the present invention includes a series of ranks and rows of apertures defined by a resilient, elastic, plastic band which has been uniquely designed to have a cross-sectional configuration that includes a series of relatively closely spaced ribs, which are interconnected by short struts of elongated plastic material. The combination of ribs and struts, in the composite create corrugated sections. This configuration, in comparison with the prior art cross-sectional configuration of a thin, flat sheet of material, will provide material content and performance advantages to be described in more detail herein.

The carrier device of the present invention is capable of being manufactured with appreciable less material than prior art devices as a result of the corrugated sections of ribs and struts. As will be apparent from the description, the selective elongation of the discrete strut portions increases the "effective" material content of the device. The corrugation of the strip is accomplished by feeding a strip of a preformed material through meshing rolls of gear-like reconfiguring devices. Each tooth of the mating gear device is designed to register in a root area in the associated mating gear. In doing so, the crest of the teeth of alternating mating gears captures a segment of the preformed sheet and stretches an adjacent segment between two captured segments to an extent sufficient to "work" or elongate the segment, beyond its elastic limit, while the captured segments are unstretched and thus retain elasticity.

It will be clear upon a further reading of the specification, that, for a given aperture size of a carrier device, significantly less material can be utilized and yet provide as much and if not, more container retention capabilities.

Other objects and features of the invention will be apparent upon perusal of the hereinafter specification read in conjunction with the drawings.

BRIEF DESCRIPTION OF THE DRAWINGS

FIG. 1 is a plan view of a finished carrier device in accordance with the present invention.

FIG. 2 is a plan view of a preform designed to create the carrier device of FIG. 1.

FIG. 3 is a side view of the apparatus utilized to create the finished carrier from the preform and also represents the side and cross-sectional configuration of the finished carrier.

FIG. 7 is a top plan view of a package of six containers created using the multi-packaging device of FIG. 1.

FIG. 8 is a partial side elevational view of the package of FIG. 7.

FIG. 9 is a partial end elevational view of the package shown in FIG. 7.

DETAILED DESCRIPTION OF THE PREFERRED EMBODIMENT

Figure 4:
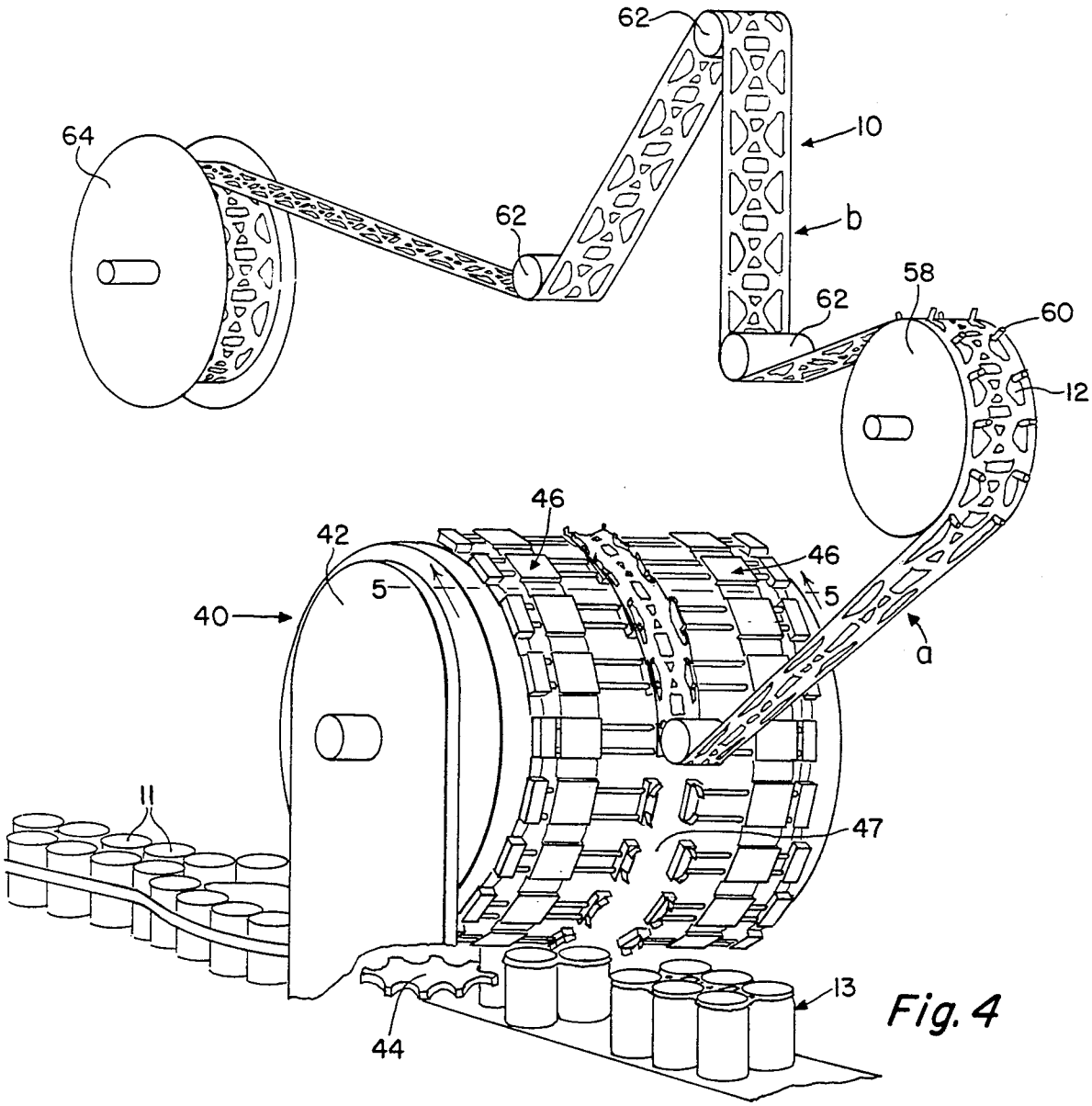
FIG. 4 is a isometric view of the applicating system used to apply a continuous strip of carriers of the present invention.

Turning first to FIGS. 1 and 2, the novel characateristics of the carrier device 10 and a preform 100 for creating such a device shall become readily apparent. the device 10 generally resembles prior art carrier devices such as shown in U.S. Pat. No. 4,219,117, in that it includes a series of D-shaped apertures 12 arranged in a plurality of ranks and rows which are created by bands 14 interconnected by webs 16 and 18. The preformed embodiment of the carrier device is shown to have two rows of three ranks to create a six-pack. The bands 14, again similar to the prior art carrier noted above, are configured to include relatively straight outer section band 21 and a U or V-shaped inner band section 22. The preferred embodiment also shows the lateral webs means 18 to be created by a plurality of longitudinally spaced straps including a pair of outer straps 15 and central strap means 17. An enlarged finger hole 20, in a preferred embodiment is shown as being positioned between web means 18. The outer band 21 may also be slightly undulating at its outer edges, providing slightly bulged regions 27 at the juncture of the outer and inner band to further strengthen the band when stretched during application.

It is important to note that the preform device 100, shown in FIG. 2 which creates the final product in FIG. 1 is significantly shorter and narrower than a typical prior art carrier for a similar container size. A representative comparison will reveal typical prior art carriers to be approximately $8\frac{1}{2}'' \times 5\frac{1}{2}''$ while a preform according to this invention for a similar application will be approximately $4'' \times 2\frac{1}{2}''$ this type of comparison will indicate that substantially less material is required to create a carrier device than as typified in the prior art. The preform 100 may be manufactured by essentially the same process that is utilized in manufacturing the prior art carrier shown in U.S. Pat. No. 4,219,117, i.e., punching predesigned apertures in an endless strip of polyethylene or similar resilient thermoplastic material.

The preform 100 is substantially identical in all respects except length and cross-sectional configuration to the finished carrier device 10 and therefore like elements are identified with like numerals with the addition of prefix 1 *in description of the preform.*

Turning back to FIG. 1 and with reference to FIG. 3, certain novel characteristics of the invention will now be described.

Device 10 will include a plurality or series of closely spaced corrugations 24 extending laterally across the device. The cross-sectional configuration of device 10 and corrugations 24 can be seen at the right most extremity of FIG. 3. The corrugations are essentially alternating thick rib sections 25 and thin strut sections 26. For purposes of this discussion "one" corrugation is defined as one complete "pitch" of the series of alternating ribs and struts as shown as "P" in FIG. 3.

The corrugations are created continuously by feeding the strip of preforms 100 into a set of meshing gear-like rollers 28 and 30 in directions of movement as shown in FIG. 3. The gears will include a series of teeth 29 and root sections 32 alternating at a given pitch. Teeth 29 will also be defined as including a crest section 31 and flank sections 33. The exact dimensions and gear parameters will of course be determined by the speed of production, thickness of material and thickness of rib and strut sections desired. As the strip of preforms 100 is fed into the meshing gears, it is grasped and reconfigured by the meshing of the teeth. The rib sections 25 will essentially remain the thickness of the preform strip, as these discrete sections are grasped by the crest 31 of one of the teeth of a gear and the root 32 of the corresponding gear. As that combination of crest and root with the discrete section therebetween become completely meshed, the regions 26 between adjacent ribs 25 are stretched, elongated, and/or compressed and become significantly thinner and molecularly oriented. The thickness of the stock and gear component dimensions and parameters are designed so that the sctions 26 do not return to their initial thickness and thus are permanently oriented, thinned and elongated.

It should also be noted from FIG. 3, that the gear meshing operation creates a wave-like pattern in cross-section for the finished device 10. The wave-like pattern will provide an alternating series of ribs extending above and below a central cross-sectional plane of the device. This alternating, wave-like configuration creates a device which can be elongated by applying predetermined lengthwise tension on the strip or device sufficient to relocate the relative elevations of the rib sections 25 to be essentially coplanar. Thus, the effective length of the device may be increased without significantly stretching the material that still has stretch capabilities, i.e., the ribs 25. since the device 10 does have "memory" or a desire to return to the shortened configuration shown in FIG. 3, there is a certain amount of static reactive tension built into the device when elongated as just described.

The carrier device 10, in its at rest or non-elongated state is also appreciable smaller than a prior art carrier. A typical carrier device, in relaxed state, will be approximately 7"×2½" compared to the prior art dimensions previously noted. Thus while, the carrier device 10 of the instant invention is appreciatively smaller than the prior art devices, it follows that device 10 must be subjected to significantly greater stretching forces than the prior art.

The carrier device 10 or series of interconnected devices are designed to be an integral part of a system for creating multi-packages in a manner similar to the systems referred to in the background of the invention.

Figure 6:
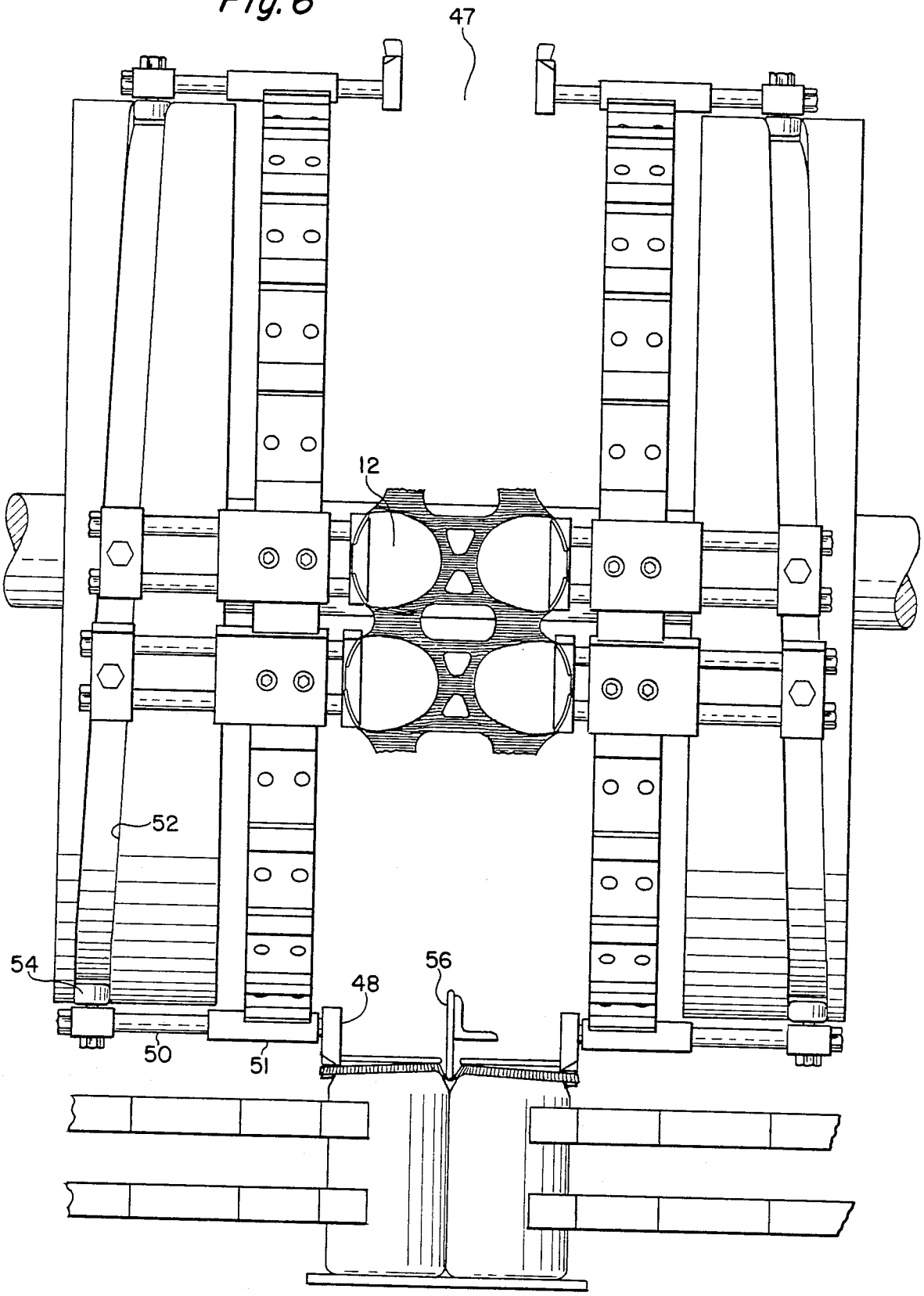
FIG. 6 is a fragmentary, enlarged, end elevational view of the wheel assembly of the applicating system shown in FIG. 4.

The preferred applicating apparatus 40, for this system is shown in FIGS. 4 and 6 and can be described as basically including; a drum-like member 42, designed to rotate about an axis which is located above conveyor feeding a series of continuous moving containers 11 through a star wheel locating means 44 to create a series of multi-packages 13.

The drum 42 will include a circumferentially arranged series of equally spaced pairs of opposing jaw assemblies 46. Each jaw assembly includes a jaw member 48 which faces a similar jaw in the opposing assembly across an open "throat" region 47 of the drum. Jaws 48 are connected by rods to a cam follower 54 which engages a cam track means 52 on either side of the throat region. The rods are supported by fixed bearing block means 51. It should be noted by comparison, that the machine described in the prior art U.S. Pat. No. 4,250,682 incorporates a drum which includes jaw assemblies that have a moving portion and a stationary portion; while the instant invention incorporates a jaw assembly with both jaw portions designed to move relative to the center line of movement of containers. Since the device of FIG. 1 is designed to be more highly stretched than any prior art device, it requires an equal distribution of the stretching forces created by the jaw mechanism, thus the departure from the rather simple teachings of the U.S. Pat. No. 4,250,682 patent while retaining the "open throat" or totally cantilevered jaw mechanism techniques.

Continuing to review FIG. 4 it will be shown that a reel 64 of the carriers which create a succession of devices 10, is positioned to be above and preferably on the entry side of the drum 42 and fed through a series of idler or guiding rollers 62 into a tensioning wheel 58. This tensioning wheel includes a circumferentially spaced series of cogs 60, each cog designed to interfit whithin each aperture 12 in the device 10. It is important to note that prior to being received on the tensioning wheel, the strip of devices resemblies the cross-sectional configuration as shown in FIG. 3, i.e., it has not been tensioned longitudinally. As the strip is fed onto and interrelated with the cogs and ultimately associated with the jaw devices 48 of the drum, it will be shown that the strip is tensioned to elongate and increase the pitch or the distance between ranks of apertures. This tensioning which occurs between the existing cog on the wheel 58 and the entry jaw assembly 46 is not appreciably stretching the thermoplastic material but essentially bringing the rib sections 25 to a coplanar position as compared to the stepped position of FIG. 3. For example, on one style of carriers, the pitch or distance between jaws 48 and distance between cans of a package, is designed to be 2.85 inches while the pitch distance of aperture 12 of the untensioned carrier device and the cogs 60 is 2.19 inches. To obtain the tensioning a speed differential between the surface of the tensioning wheel and the jaw members is created so that there is a drag palced upon the carrier device from the wheel 58 to the drum 42 thus causing it to be elongated between the tensioning wheel and the drum mechanism. This surface speed differential can be accomplished in a number of ways, for example, the preferred manner is to develop a tensioning wheel with a diameter less than that of the diameter of the drum and rotate the tensioning wheel and drum at the same rotational speed by driving them off the same mechanism thus creating a surface speed of the jaws greater than the surface speed of the cogs.

Figure 5:
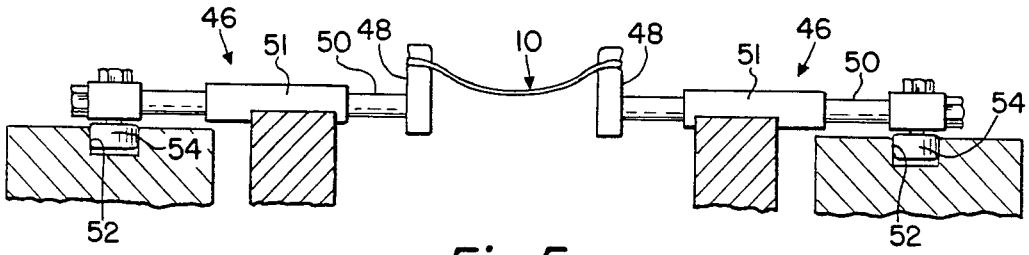
FIG. 5 is a cross-sectional view of a portion of the applicating system taken along line 5—5 of FIG. 4.

The tensioned strip section "a" as represented in FIG. 4 and in comparison to untensioned section "b" is bowed since the tensioning pressure is essentially at the outer margins of the strip with no control at the innermost regions of the carriers. This configuration is shown clearly in the bow shaped section as shown in FIG. 5. This bow shaped section tends to facilitate the alignment of the outer bands on the jaws in that they assume a position that does not require pre-alignment to create a surface engagement between the jaws and the bands. Heretofore the prior art systems required some sort of a positive band alignment devide to insure that the bands, when placed on the jaws, uniformly would uniformly instantaneously assume the proper position against the surface of the jaws.

A more detailed showing of the application drum 42 is shown in partial assembly FIG. 6 with the cams 52, cam followers 54, jaws 48 and pretensioned carrier 10 in a practically totally laterally stretched arrangement. As in the prior art machine the carrier device is stripped from the jaws through the use of a stripping plate 56 as the can tops are inserted through the laterally stretched apertures.

As the stream of containers is fed through the machiine of FIG. 4 with a suitable apparatus at the exit end, not shown, the continuous strip and the continuous stream of containers are separated into their desired array, for example a six pack 13.

The packages 13 thus created are shown more clearly in FIGS. 7, 8 and 9. These FIGS. show that the rib-like or corrugated structure described in detail relative to the device of FIG. 1, creates a closely spaced series of ribs 24 which act as struts abutting against the rims 15 of the cans, thus serving to essentially stiffen the package while minimizing the material content. It should be recalled that the struts or thick rib sections 25 are regions which have a stretch capability remaining in them while the thin, oriented, sections 26, have essentially no stretch remaining in them. These thinned oriented section 26, however support and compliment the strut-like configuration of the bands. It has been found that a package 13 created using the device 10 can be manufactured with approximately 25% less material than the prior art device of U.S. Pat. No. 4,119,117 while retaining the cans under jolting conditions as well as if not better than the prior art device.

A preferred embodiment of the device 10 and package 13 will have a density of corrugations 24 which is approximately 40 to 50 per inch. This density creates an appropriate number of ribs and individually stretchable thick sections 25 about the periphery of the band and can.

It should be clear that the bands creating the dimension of the apertures 12 can be significantly increased in diameter e.g., in the range of 2 to 1 from the original diameter. This will become apparent in comparing the apertures shown in FIG. 1 to the dimension of the diameters of the cans associated with the device shown in FIG. 7. This comparison clearly illustrates one of the important features of the invention i.e., ability to use far less material, reconfigure the device by stretching significantly and still create a usuable, functional package.

Thus it should be apparent that a unique and clearly advantageous multi-packaging system is created by this invention. One in which a carrier device can be created which is capable of utilizing significantly less material than prior art devices, capable of being stretched significantly greater amounts without failure, capable of creating a package which is equal to or superior to the prior art devices which utilize more material, capable of being incorporated into a multi-packaging system which utlizes very high-speed applicating machines that cooperate and compliment the carrier design.

Having described the invention it should be clearly understood that changes can be made in the described in the preferred embodiments by one skilled in the art and still be within the spirit and scope of the hereinafter described claims.

I claim:

1. A method for manufacturing multi-packaging devices including the steps of; providing an elongated web of resilient plastic materials, creating a series of preforms by producing a lengthwise series of apertures of a predetermined size, configuration and pitch in said web, deforming and elongating the preforms by producing a series of transverse corrugations which include small discrete sections of lengthwise, elongated, carrier material, wherein a series of carrier devices are created which include apertures of increased aperture length and pitch from the preform aperture length and pitch.

2. The method of claim 1 wherein the preforms are deformed and corrugations thereby provided by meshing gear-like rollers.

3. The method of claim 1 wherein the pitch of the apertures and length of the apertures are increased approximately 20%.

* * * * *